US005586497A

United States Patent [19]

Shimada

[11] Patent Number: 5,586,497

[45] Date of Patent: Dec. 24, 1996

[54] STENCIL PRINTING MACHINE WITH STENCIL TENSIONING MEMBER

[75] Inventor: Shingo Shimada, Tokyo, Japan

[73] Assignee: Riso Kagaku Corporation, Tokyo, Japan

[21] Appl. No.: 494,025

[22] Filed: Jun. 23, 1995

[30] Foreign Application Priority Data

Jul. 4, 1994 [JP] Japan ..... 6-152353

[51] Int. Cl.[6] ..... B41L 13/04

[52] U.S. Cl. ..... 101/128.4; 101/477

[58] Field of Search ..... 101/114, 116, 101/117, 118, 128.21, 128.4, 477

[56] References Cited

FOREIGN PATENT DOCUMENTS 287781 12/1986 Japan ..... 101/128.4

*Primary Examiner*—Stephen R. Funk

*Attorney, Agent, or Firm*—Kanesaka & Takeuchi

[57] ABSTRACT

A stencil printing machine comprising a cylindrical printing cylinder around which a perforated stencil sheet for mimeographing is wrapped; a stencil sheet storing section for storing a blank stencil for mimeographing; a stencil sheet perforator for perforating a stencil sheet fed from the stencil sheet storing section; a stencil sheet cutter disposed between the stencil sheet perforator and the printing cylinder, for cutting the perforated stencil sheet; a stencil sheet stocking section disposed between the stencil sheet perforator and the stencil sheet cutter, for holding the perforated stencil sheet; a single long member which is mounted, inside the stencil sheet stocking section, in parallel with a direction of width of the stencil sheet, beneath the stencil sheet stocked inside the stencil sheet stocking section, and is vertically movable between the upper limit position and the lower limit position; a driving mechanism for moving the long member up and down; and a stencil sheet feeder for feeding the perforated stencil sheet from the stencil sheet stocking section to the stencil sheet cutter.

7 Claims, 6 Drawing Sheets

STENCIL PRINTING MACHINE WITH STENCIL TENSIONING MEMBER

BACKGROUND OF THE INVENTION

The present invention relates to a stencil printing machine capable of performing stencil perforation and printing continuously.

A stencil printing machine capable of perforating a stencil and printing simultaneously as disclosed for example in Japanese Patent Application No. Sho 60-129600 has been known, in which during printing by the use of a first original copy, the following stencil to be used will be perforated in advance by a next original copy and reserved, so that the stencil for mimeographing (hereinafter called the "stencil") reserved will be fed successively to a printing cylinder every time the printing of the preceding original copy is completed.

In such a stencil printing machine, slack portions of a stencil reserved tend to cling fast to each other, interrupting the movement of the stencil. To prevent such interruption of the movement of the stencil, there has been disclosed in the aforesaid Japanese Patent Application No. Sho 60-129600 a stencil sheet stocking means as shown in FIG. 6.

In the drawing, numeral 100 denotes a stencil sheet storing section; 101 represents a stencil sheet perforating means which comprises a thermal head 102 and a platen 103; and 104 is a stencil sheet cutting means which comprises a fixed blade 105 and a moving blade 106. Numeral 107 refers to a stencil sheet stocking means, which comprises a box-like stencil sheet stocking section 108 which is capable of holding a stencil S, stencil feed rollers 109, a stencil feed roller 110, an idle roller 111, and tension bars 112 and 113. The idle roller 11, which is rotatable, is fixedly disposed in an illustrated position. The tension bars 112 and 113 of specific weight are designed to move downwardly with the feed of the stencil S into the stencil sheet stocking section 108, and to move upwardly with the feeding of the stencil out to the stencil sheet cutting means 104 by means of the stencil feed roller 110.

In the stencil printing machine equipped with the above-described stencil sheet stocking means shown in FIG. 6, the perforated stencil sheet can be reserved in an approximately W form, thus effectively preventing slack portions of the stencil from clinging to each other. However, in such a stencil printing machine, the stencil is likely to be excessively loaded with the tension bars 112 and 113 because of its construction, damaging the stencil.

It is an object of the present invention to provide a stencil printing machine equipped with a stencil sheet stocking means which is able to reserve a perforated stencil sheet without damage and to smoothly deliver the stencil from a reserving section.

SUMMARY OF THE INVENTION

The stencil printing machine of a first aspect of the present invention comprises a cylindrical cylinder on the outer peripheral surface of which a perforated stencil sheet for mimeographing is wrapped; a stencil sheet storing section for holding a blank stencil for mimeographing; a stencil sheet perforating means for perforating a stencil for mimeographing that has been fed from the above-described stencil sheet storing section; a stencil sheet cutting means disposed between the stencil sheet perforating means and the printing cylinder, for cutting the stencil that has been prepared for mimeographing; a stencil sheet stocking section disposed between the stencil sheet perforating means and the stencil sheet cutting means, for holding the stencil that has been prepared for mimeographing; one long member which is arranged within the stencil sheet stocking section, in parallel with the direction of width of the stencil for mimeographing, below the stencil held in the stencil sheet stocking section, and moves up and down between the upper limit position and the lower limit position; a driving mechanism for moving the long member up and down; and a stencil feeding means for feeding the perforated stencil sheet from the stencil sheet stocking section to the stencil cutting means.

The stencil printing machine of a second aspect of the present invention is characterized in that the long member stated in the stencil printing machine of the first aspect is a single shaft body which is driven to rotate in a direction in which the perforated stencil sheet is fed towards the stencil sheet cutting means when moving upwards in the stencil sheet stocking section.

The stencil printing machine of a third aspect of the present invention has, in the stencil printing machine of the second aspect, a pair of side plates disposed in the stencil sheet stocking section in parallel with each other at a specific distance and provided with a groove of a specific length continuing in a vertical direction; a single shaft body disposed between the aforesaid pair of side plates, having two end portions each of which is vertically movably engaged in each groove of a pair of side plates stated above; a gear coaxially mounted on the end portions of the shaft body and disposed outside of the side plate; a rack disposed near the stencil sheet cutting means on either side of the groove of the side plate, outside of each side plate, and engaged with the gear stated above; and a driving mechanism for moving the shaft body vertically along the groove of the side plate.

The stencil printing machine of a fourth aspect of the present invention has a groove of the aforesaid side plate which, in the stencil printing machine of the third aspect, is inclined to the vertical direction.

The stencil printing machine of a fifth aspect of the present invention features that the shaft body in the stencil printing machine of the fourth aspect has been surface-treated for causing friction between the shaft body and the stencil.

The mimeograph of a sixth aspect of the present invention is provided with a suction means for sucking the stencil in the stencil sheet stocking section, at the bottom section of the stencil sheet stocking section in the stencil printing machine of the first aspect.

According to the stencil printing machine of a seventh aspect of the present invention, when, in the stencil printing machine of the first aspect, the amount of the perforated stencil sheet held in the stencil sheet stocking section exceeds a specific amount, the long member rises toward the upper limit position in the stencil sheet stocking section, to hold upwards from below at about the central part of the stencil, thus holding the stencil within the stencil sheet stocking section.

When the long member goes upwards with the movement of a perforated stencil sheet into the stencil sheet stocking section, the stencil is folded into an approximately W form, being reserved inside the stencil sheet stocking section. In the case of a long member which is a shaft body, when the long member is rotated in a direction in which the stencil is fed into the stencil sheet cutting means during the upward movement of the shaft body, the stencil is held nearly equally on both sides of the shaft body. The shaft body is surface-treated to produce friction between the surface of the shaft body and the stencil, so that the feeding of the stencil towards the stencil sheet cutting means side can be done properly. Furthermore, a suction means is provided at the bottom of the stencil sheet stocking section to ensure properly moving the stencil downwards and into contact with the shaft body, thereby exactly folding the stencil in an approximately W form. By driving the stencil feeding means or by downwardly moving the shaft body with the driving of the stencil feeding means, the stencil reserved can be fed to the stencil cutting means.

The above-mentioned and other objects, aspects and advantages will become more obvious from the following description when taken in connection with the accompanying drawings.

DETAILED DESCRIPTION OF THE PREFERRED EMBODIMENT

Figure 1:
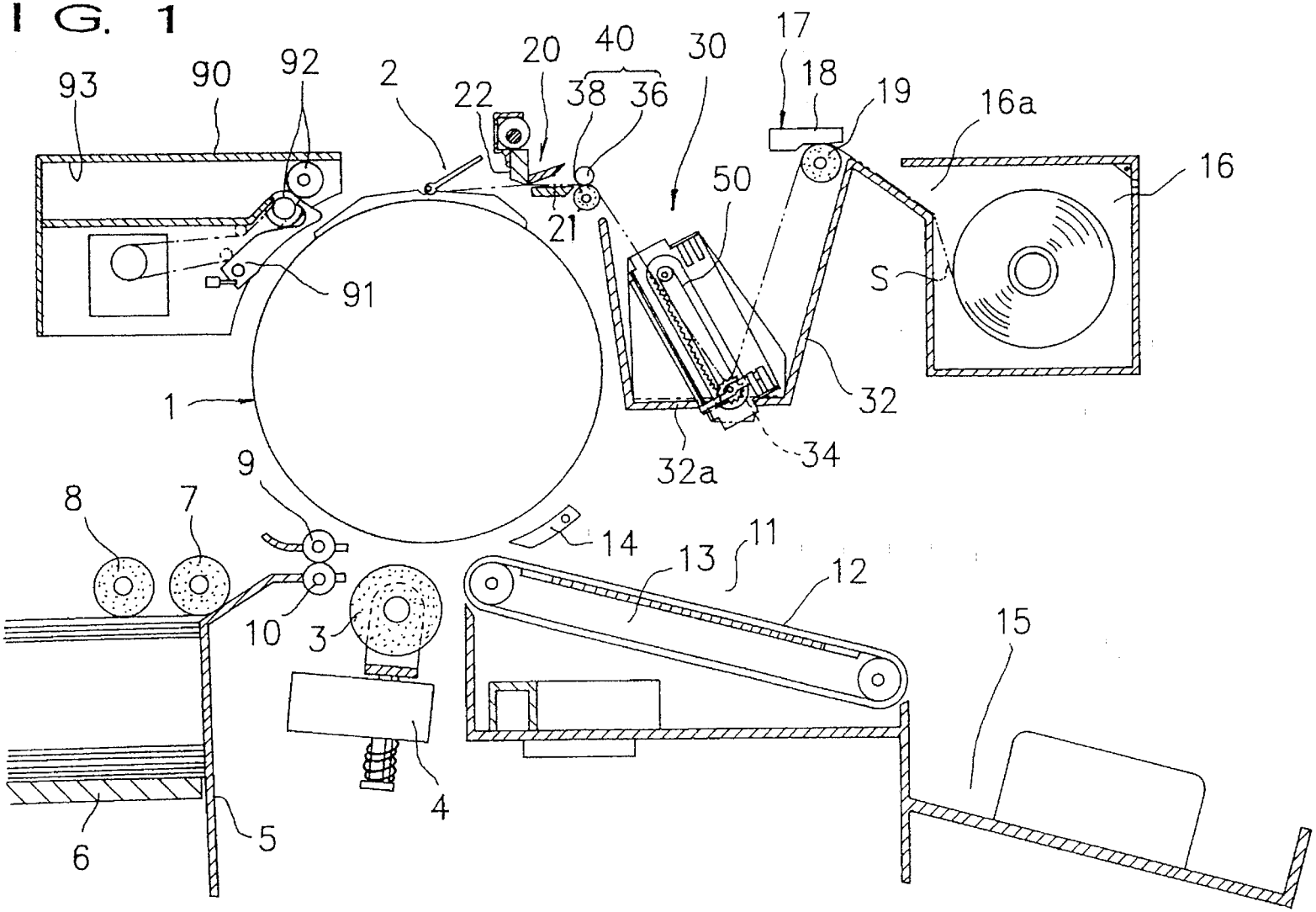
FIG. 1 is a schematic block diagram showing one embodiment of a stencil printing machine according to the present invention.

FIG. 1 is a schematic block diagram showing one embodiment of a stencil printing machine equipped with a stencil sheet stocking means. In this drawing, numeral 1 denotes a cylindrical printing cylinder. The printing cylinder 1 is a cylindrical body of a multi-porous structure. On the outer peripheral surface of the printing cylinder 1 is provided a clamping means 2 for clamping one end of the stencil. Inside the printing cylinder 1 is provided an ink supply device not illustrated, to supply the ink to the inner peripheral surface of the printing cylinder 1. The printing cylinder 1 is driven to rotate in a counterclockwise direction around the central axis of its own by a driving means not illustrated.

Below the printing cylinder 1 is provided a press roller 3, which is selectively raised towards the outer peripheral surface of the printing cylinder 1 by the operation of a press solenoid 4.

Beneath one adjacent part (at left in FIG. 1) of the printing cylinder 1 is disposed a paper feed device 5. The paper feed device 5 has a paper feed table 6 capable of loading a plurality of sheets of printing paper. Printing paper placed on the paper feed table 6 is taken out one by one, starting with the topmost one, by means of a paper combing roller 7 and a feed roller 8, being fed in between the printing cylinder 1 and the press roller 3 by means of a timing roller 9 and a guide roller 10.

When the paper is fed in between the printing cylinder 1 and the press roller 3 by means of the paper feed device 5, the press roller 3 is moved towards the printing cylinder 1 simultaneously with this paper feeding operation, the paper being held between the printing cylinder 1 and the press roller 3. Thus with the rotation of the printing cylinder 1, the press roller 3 rotates to carry the paper. The printing ink that has passed through the cut section of the stencil from the inner peripheral surface of the printing cylinder 1 is transferred to the paper, thus performing faithful printing of an image cut in the stencil on the paper.

Beneath the other adjacent part (at right in FIG. 1) of the printing cylinder 1, there is provided a belt conveyor-type paper delivery device 11. The paper delivery device 11 has a belt conveyor 12, a suction box device 13, and a separating claw 14. A printed sheet peeled off from the printing cylinder 1 by the separating claw 14 is sucked by the suction box device 13 and carried properly on the belt conveyor 12 towards the paper delivery table 15.

Above the other adjacent part (at right in FIG. 1) of the printing cylinder 1 is provided a stencil sheet storing section 16. The stencil sheet storing section 16 is an approximately box-type component member, which rotatably holds a cylindrical roll of continuous sheet stencil S. The stencil sheet storing section 16 is provided with an opening **16*a* on the printing cylinder 1** side, through which the sheet stencil S unwound from the cylindrical roll of stencil S is led outside.

Between the stencil sheet storing section 16 and the printing cylinder 1 there is provided a stencil sheet perforating means 17. The stencil sheet perforating means 17 has a thermal head 18 which is a heat-sensitive stencil making means, and a platen roller 19, for thermally perforating the stencil S that has been fed from the stencil sheet storing section 16.

There is provided a stencil sheet cutting means 20 between the stencil sheet perforating means 17 and the printing cylinder 1. The stencil sheet cutting means 20 has a fixed blade 21 and a movable blade 22, by both of which the stencil S is cut.

Between the stencil sheet perforating means 17 and the stencil sheet cutting means 20 is provided a stencil sheet stocking means 30 for temporarily holding the perforated stencil sheet. The stencil sheet stocking means 30 is provided with an approximately box-type stencil sheet stocking section 32 for holding the perforated stencil sheet, a shaft body 34 which is a long member provided inside the stencil sheet stocking section 32, a driving means for moving the shaft body 34 up and down in the stencil sheet stocking section 32, and a stencil feeding means 40 for feeding the stencil from the stencil sheet stocking section 32 to the stencil sheet cutting means 20.

Figure 2:
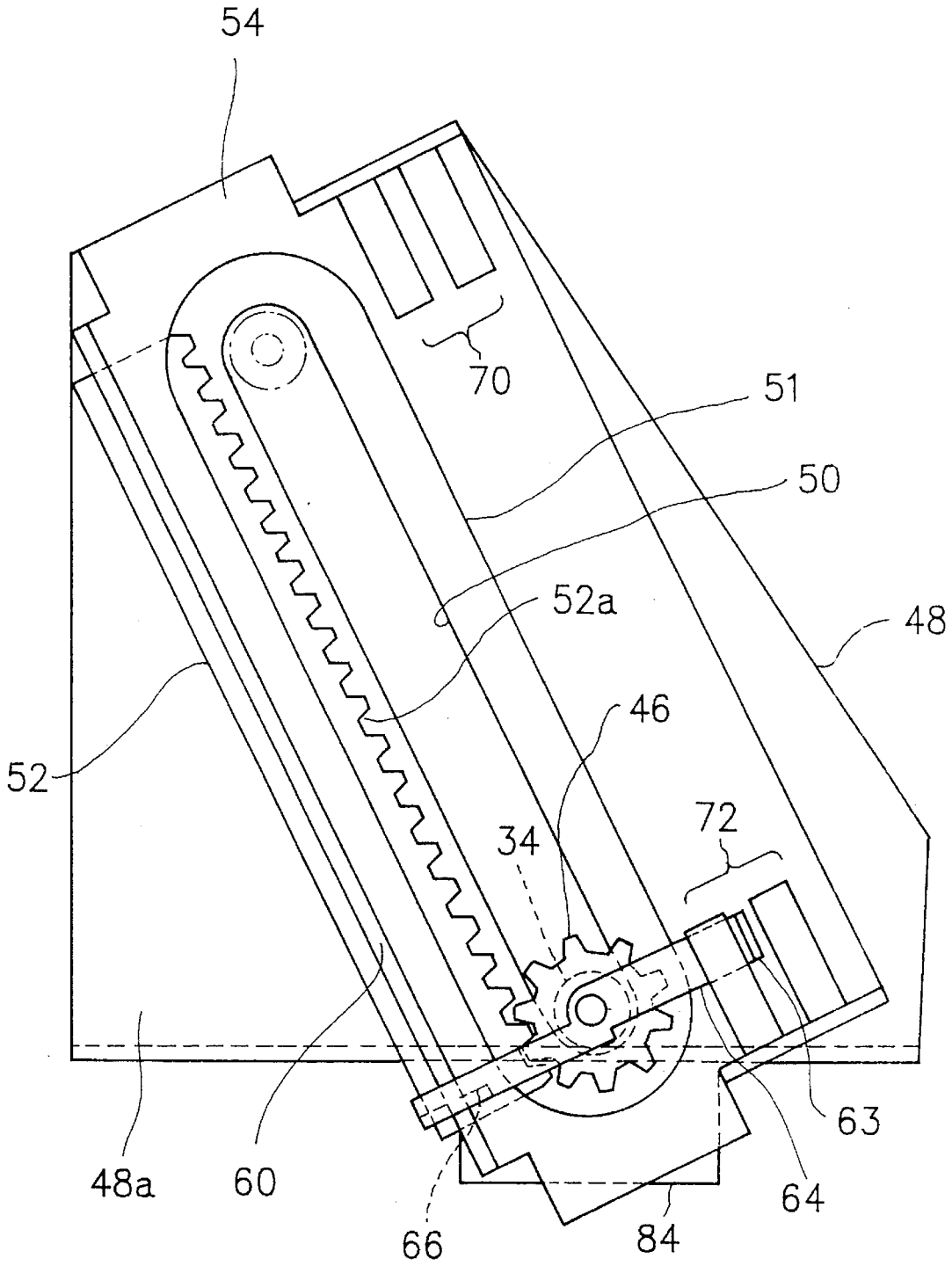
FIG. 2 is a front view showing a major portion of a stencil sheet stocking means in the stencil printing machine of FIG. 1.
Figure 3:
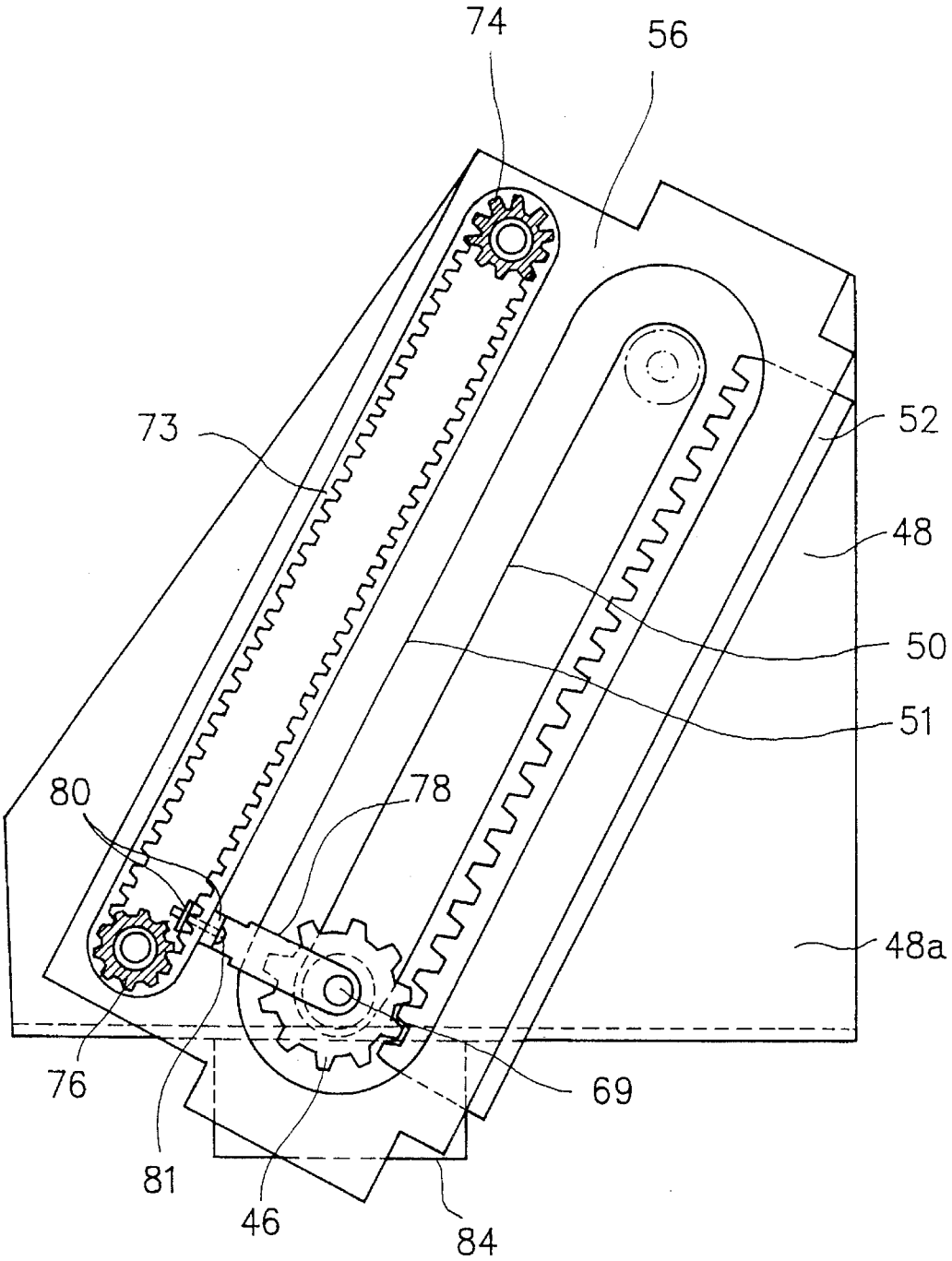
FIG. 3 is a rear view showing a major portion of the stencil sheet stocking means in the stencil printing machine of FIG. 1.
Figure 4:
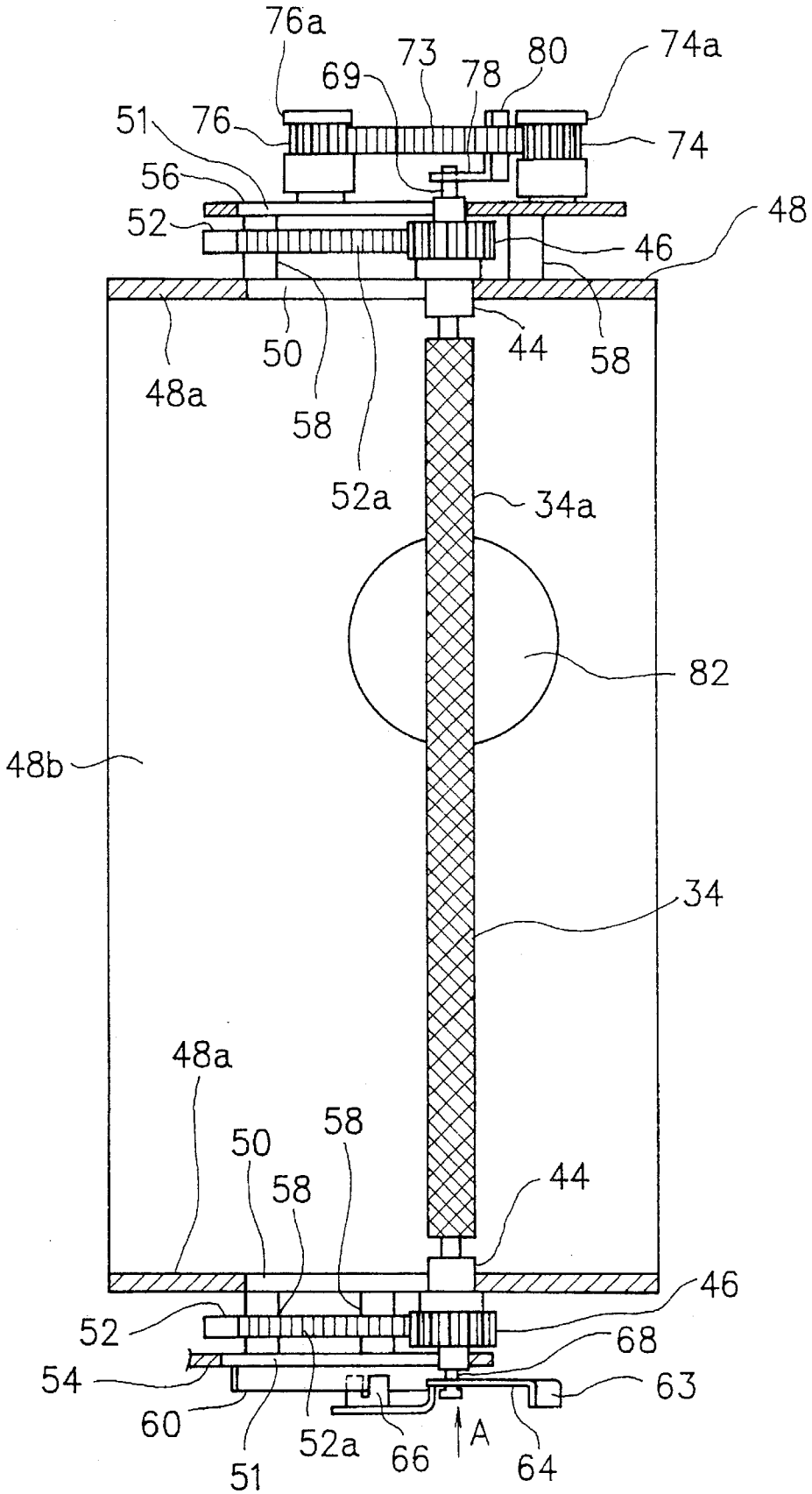
FIG. 4 is a plan view showing a major portion of the stencil sheet stocking means in the stencil printing machine of FIG. 1.

The approximately box-type stencil sheet stocking section 32 is open at the top and has the shaft body 34 and the driving mechanism of the shaft body 34 inside. FIGS. 2 to 4 show the shaft body 34 and the driving mechanism of the shaft body 34.

At the bottom section **32*a* of the stencil sheet stocking section 32 a base 48 is provided. The base 48 has a pair of approximately trapezoidal side plates (side members) 48*a*, 48*a*, and a bottom plate 48*b* connecting the bottom side of the side plates 48*a*, 48*a*. The side plates 48*a*, 48*a* are provided with grooves 50, 50 respectively. As shown in FIG. 1, in the approximately box-type stencil sheet stocking section 32, the top end of the groove 50 is located near the stencil sheet cutting means 20, while the bottom end thereof is so inclined as to be positioned on the stencil sheet storing section 16** side.

On the outer surface of each side plate 48*a* are fixed rack plates 52, 52 and supporting plates 54 and 56 by means of a connecting member 58. The rack plate 52 has a rack 52*a*, and is attached on the side plate 48*a* in such a manner that the rack 52*a* will be positioned in parallel with the lower side of the groove 50. The supporting plates 54 and 56 are fixedly installed on the side plates 48*a*, 48*a* so as to be positioned outside of the rack plates 52, 52, and have grooves 51, 51 which are larger than the grooves 50, in positions corresponding to the grooves 50.

Between the side plates 48*a*, 48*a* the shaft body 34 is mounted. The shaft body 34 is a round bar-type member, the surface 34*a* of which is knurled to prevent slippage. On both ends of the shaft body 34 are coaxially fixed cylindrical bodies 44. Each of the cylindrical bodies 44 is engaged with the groove 50 of each side plate 48*a*. The diameter of the cylindrical body 44 is much the same as the width of the groove 50. With the rotation of the cylindrical body 44 within the groove 50 along the longitudinal direction of the groove 50, the shaft body 34 can move along the groove 50.

On the outer ends of each cylindrical body 44 gears 46 are coaxially fixed. Each gear 46 is positioned outside of each side plate 48*a*, and is in mesh with each rack 52*a* of each rack plate 52.

On the outside surface of the supporting plate 56 are provided a pair of gears 74 and 76. A belt 73 is wrapped around belt engaging sections 74*a* and 76*a* of the gears 74 and 76. The belt 73 is arranged nearly in parallel with the groove 51 in the upper part of the groove.

On the outer end face of the gear 46 on the supporting plate 56 side, a shaft 69 is mounted coaxially as the rotating shaft of the gear 46. On this shaft 69 one end portion of a driving plate 78 is rotatably carried. On the other end portion of the driving plate 78 is mounted a locking piece 80. The locking piece 80 is secured by a bolt 81 to a part of the belt 73. Therefore when the belt 73 is driven, the gear 46 rotates along the rack 52*a* with the rotation of the belt 73 and the shaft body 34 moves up and down while rotating along the groove 50. For example, in FIG. 2 viewed in the direction of the arrow A in FIG. 4, the shaft body 34 rotates counterclockwise with its upward movement along the groove 50.

On the outer end face of the gear 46 on the supporting plate 54 side, a shaft 68 is coaxially mounted as the rotating shaft of the gear 46. This shaft 68 is rotatably mounted with the approximately central part of a moving plate 64. On one end part of the moving plate 64 is mounted a guide section 66. The guide section 66 is slidably engaged with a guide rail 60 formed on the outside surface of the supporting plate 54.

Outside of the supporting plate 54 there are provided optical position sensors 70 and 72 in both positions corresponding to the top and bottom ends of the groove 50. The position sensors 70 and 72 output a signal in accordance with the interruption of their optical paths. On the other end of the moving plate 64 is mounted a detecting plate 63 which interrupts the optical path of each of the position sensors 70 and 72.

Therefore, when the belt 73 is driven in both the normal and reverse directions to move the shaft body 34 up and down, the guide section 66 moves up and down, together with the shaft body 34, without rotating the moving plate 64 which is engaged with the guide rail 60. The detecting plate 63 of the moving plate 64 actuates the position sensors 70 and 72 at the upper and lower limit positions of the shaft body 34, producing a position detection signal.

Nearly at the central part of the bottom plate 48*b* of the base 48 a through hole 82 is formed. Below the through hole 82 is provided a suction fan 84 to draw in the air downwards from the stencil sheet stocking section 32.

The stencil feeding means 40 for feeding the stencil from the stencil sheet stocking section 32 to the stencil sheet cutting means 20 is disposed between the edge section on the printing cylinder 1 side of the stencil sheet stocking section 32 and the stencil sheet cutting means 20. The stencil feeding means 40 of the present embodiment is composed of a pair of stencil feed rollers 36 and 38.

There is provided a stencil delivery apparatus 90 on the opposite side of the stencil sheet cutting means 20 across the printing cylinder 1. The delivery apparatus 90 has a stencil separating claw 91 for stripping a used stencil from the printing cylinder 1 by rocking, a stencil discharge roller 92 for discharging the stencil stripped, and a stencil receiving box 93 for holding the stencil discharged by means of the stencil discharge roller 92.

Operation of a major portion of this apparatus will be explained by referring to FIGS. 1 to 5. When the second stencil and after are prepared and stored in the stencil sheet stocking section 32, the shaft body 34 is held in the lower limit position until the stencil comes to the S1 position. When the stencil has come to the S1 position in FIG. 5, or to a position a little before the S1 position, the driving of the shaft body 34 starts to gradually raise the shaft body 34 in accordance with the stencil preparation speed. The amount of slackness of the stencil can be detected from the rotation of the platen roller 19.

Figure 5:
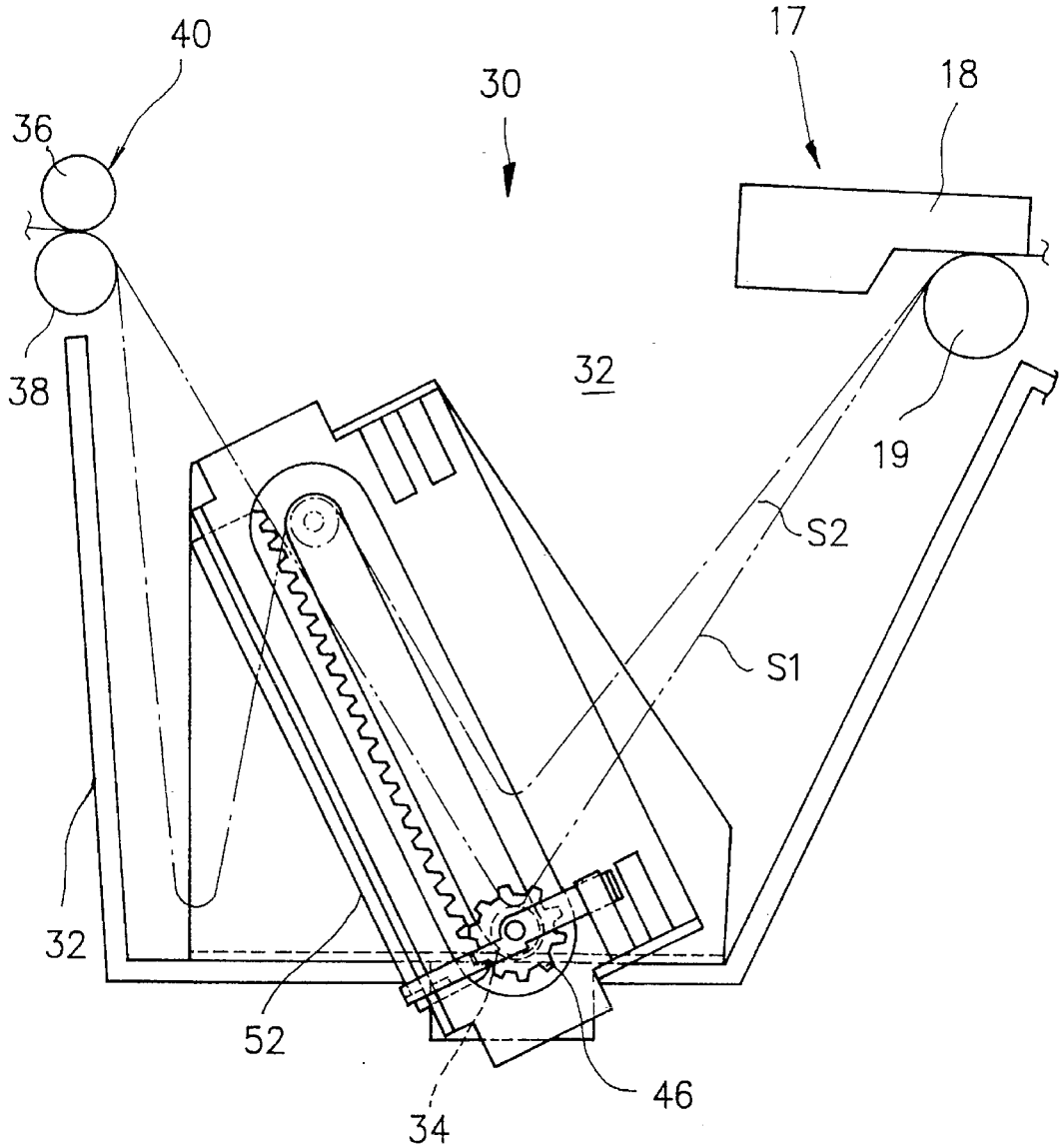
FIG. 5 is a view for explaining a stencil sheet stocking operation in the embodiment.
Figure 6:
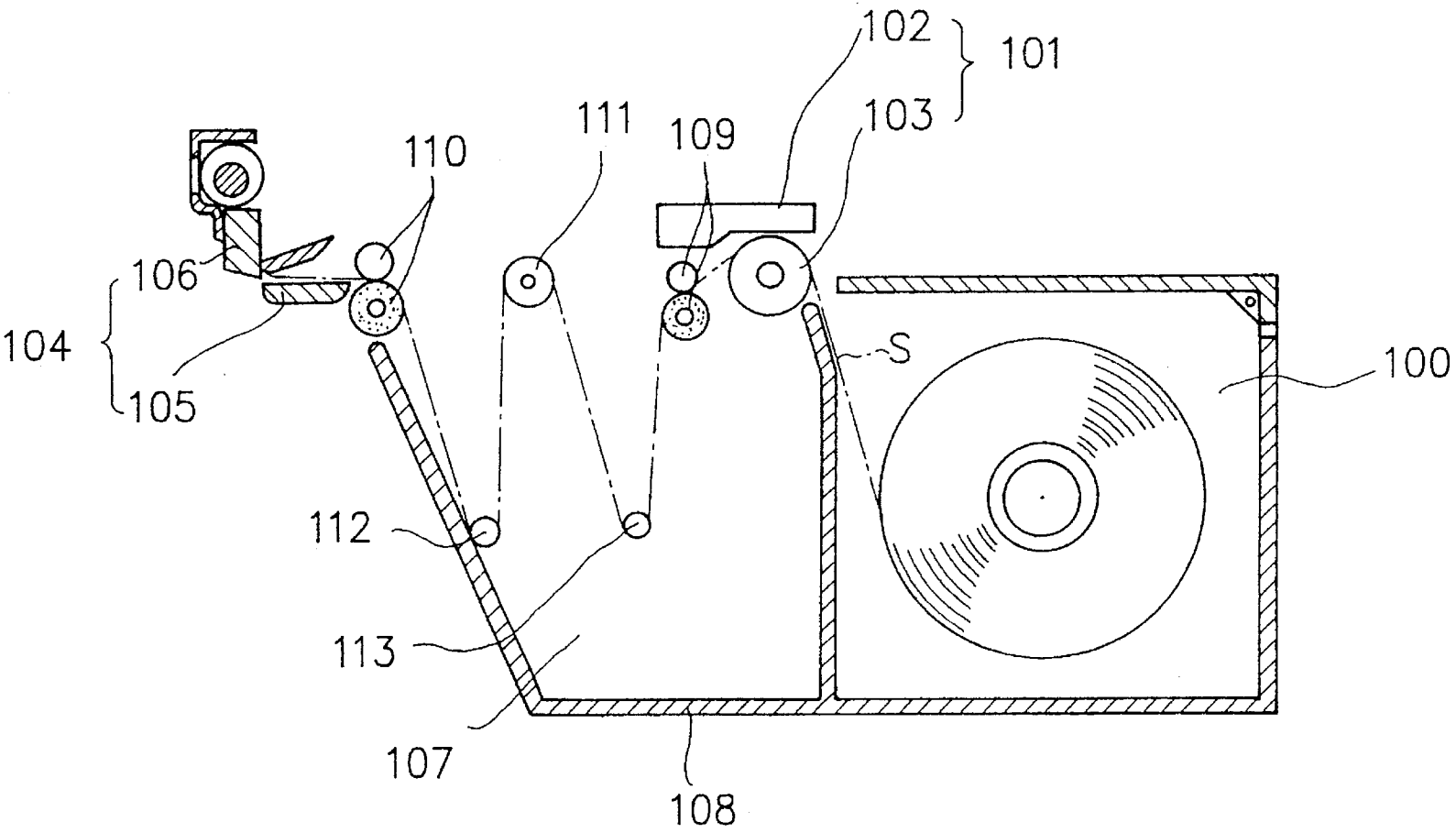
FIG. 6 Prior Art
FIG. 6 is a sectional view showing the stencil sheet stocking means of a conventional mimeograph apparatus.

With the upward movement of the shaft body 34 while rotating counterclockwise in FIG. 5, the stencil in contact with the upper part of the shaft body 34 is gradually pushed out towards the stencil sheet cutting means 20. When the shaft body 34 has come to the upper limit position, the stencil is reserved within the stencil sheet stocking section 32 in an approximately W form as S2 shown in FIG. 5.

When the stencil is fed out, the shaft body 34 is fixed in the upper limit position or, simultaneously with, or a specific time after, the driving of the stencil feed roller 38, the shaft body 34 is gradually lowered from the upper limit position so that the shaft body 34 will reach the lowermost position simultaneously with or after the taking out of the stencil.

In the case of the present embodiment, the rack plate has been set within the range of inclination angle (an angle between the rack plate and the horizontal surface) of 60 to 70 degrees. This inclination serves to prevent the shaft body from vibrating during movement. This purpose can be attained by vertically forming the groove 50 without providing the inclination.

According to the stencil printing machine of the present invention, it is possible to reserve the perforated stencil sheet in an approximately W form without applying an excessive tension to the stencil, and to ensure smooth, trouble-free movement of the stencil while properly preventing damage to the stencil.

What is claimed is:

1. A stencil printing machine, comprising:

a cylindrical printing cylinder around an outer peripheral surface of which a perforated stencil sheet can be wrapped;

a stencil sheet storing section for holding a blank stencil;

a stencil sheet perforating means for perforating a stencil sheet fed from said stencil sheet storing section;

a stencil sheet cutting means disposed between said stencil sheet perforating means and said printing cylinder, for cutting a perforated stencil sheet;

a stencil sheet stocking section disposed between said stencil sheet perforating means and said stencil sheet cutting means, for stocking a perforated stencil sheet;

a single long member disposed, inside said stencil sheet stocking section, in parallel with a direction of width of said stencil sheet beneath said stencil sheet stocked inside said stencil sheet stocking section, and movable between an upper limit position and a lower limit position;

a driving mechanism for moving said long member up and down; and a stencil sheet feed means for feeding said perforated stencil sheet from said stencil sheet stocking section to said stencil sheet cutting means.

2. A stencil printing machine according to claim 1, wherein said long member is a single shaft body which is driven to rotate in a direction in which said perforated stencil sheet is fed to said stencil sheet cutting means when moving upwards inside said stencil sheet stocking section.

3. A stencil printing machine according to claim 2, further comprising:

a pair of side members mounted inside said stencil sheet stocking section in parallel with each other at a specific spacing, said each side member being provided with a vertically continuous groove of specific length, said single shaft body having two end portions, in which groove each end portion of said single shaft body is vertically movably engaged;

a gear coaxially mounted on each end portion of said shaft body, outside of said side member;

a rack in mesh with said gear, said rack being arranged in parallel with said groove on a near side to said stencil sheet cutting means out of both sides of said vertically continuous groove, outside of each of said side members, so that said shaft body is driven up and down along said groove of said side member by said driving mechanism.

4. A stencil printing machine according to claim 3, wherein said groove of said side member is inclined in relation to a vertical direction.

5. A stencil printing machine according to claim 4, wherein said shaft body is surface-treated to produce friction between said stencil sheet.

6. A stencil printing machine according to claim 1, wherein there is provided a suction means at a bottom of said stencil sheet stocking section, for downward sucking said stencil sheet stocked in said stencil sheet stocking section.

7. A stencil printing machine according to claim 1, wherein said long member is moved upwards towards an upper limit position inside said stencil sheet stocking section when the amount of perforated stencil sheet stocked inside said stencil sheet stocking section has exceeded a specific value, raising about a central part of said stencil sheet from below, to thereby hold said stencil sheet inside said stencil sheet stocking section.

* * * * *